US011007561B2

(12) United States Patent
Veronese

(10) Patent No.: US 11,007,561 B2
(45) Date of Patent: May 18, 2021

(54) GRIPPER SYSTEM FOR A BENDING PRESS

(71) Applicant: TRUMPF Maschinen Austria GmbH & Co. KG., Pasching (AT)

(72) Inventor: Roberto Veronese, Chieri (IT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 218 days.

(21) Appl. No.: 15/772,153

(22) PCT Filed: Nov. 3, 2016

(86) PCT No.: PCT/EP2016/076585
§ 371 (c)(1),
(2) Date: Apr. 30, 2018

(87) PCT Pub. No.: WO2017/076985
PCT Pub. Date: May 11, 2017

(65) Prior Publication Data

US 2018/0311720 A1 Nov. 1, 2018

(30) Foreign Application Priority Data

Nov. 4, 2015 (AT) ..... A 50937/2015

(51) Int. Cl.
*B21D 37/14* (2006.01)
*B21D 5/02* (2006.01)
*B30B 15/02* (2006.01)

(52) U.S. Cl.
CPC ..... *B21D 37/14* (2013.01); *B21D 5/0254* (2013.01); *B21D 5/0236* (2013.01); *B30B 15/026* (2013.01)

(58) Field of Classification Search
CPC .. B21D 5/0236; B21D 5/0254; B21D 5/0209; B21D 37/14; B21D 37/145;
(Continued)

(56) References Cited

U.S. PATENT DOCUMENTS 6,662,619 B1 * 12/2003 Ikeda ..... B21D 5/04 72/319
9,339,860 B2 5/2016 Denkmeier
(Continued)

FOREIGN PATENT DOCUMENTS

AT 508 923 A4 5/2011
AT 511 078 B1 9/2012
(Continued)

OTHER PUBLICATIONS

International Search Report of PCT/EP2016/076585, dated Feb. 2, 2017.

*Primary Examiner* — Teresa M Ekiert
*Assistant Examiner* — Sarkis A Aktavoukian
(74) *Attorney, Agent, or Firm* — Collard & Roe, P.C.

(57) ABSTRACT

The invention relates to a gripper system (16) for a press brake (2), having a gripping device (11) for manipulating a bending tool (6). The gripping device (11) comprises a first gripping arm (21) and a second gripping arm (22) that is displaceable in the clamping direction (26) relative to the first gripping arm (21), said gripping arms (21) being configured to engage in a gripping groove (17, 18) of a bending tool (6) and to clamp the bending tool (6). The gripping device (11) is arranged on a carriage system (46), said carriage system (46) comprising a horizontal linear guide (47) by means of which the gripping device (11) is displaceable towards the gripping groove (17, 18) or away from the gripping groove (17, 18) in the longitudinal direction (35) of the gripping arms (21, 22).

7 Claims, 17 Drawing Sheets

(58) Field of Classification Search
CPC .... B21D 37/147; B21D 37/04; B21D 5/0245; B30B 15/026; B30B 15/028; B30B 15/02; B25B 11/00
USPC ..... 72/453.01, 453.02; 29/50, 283, 56.6; 269/55, 32, 37
See application file for complete search history.

(56) References Cited

U.S. PATENT DOCUMENTS

| | | | | |
|---|---|---|---|---|
| 2001/0032553 | A1* | 10/2001 | Finkler | B30B 15/287 100/342 |
| 2005/0097940 | A1 | 5/2005 | Strasser et al. | |
| 2012/0031217 | A1 | 2/2012 | Jin et al. | |
| 2015/0258594 | A1* | 9/2015 | Sato | B21D 37/145 483/28 |
| 2017/0232493 | A1 | 8/2017 | Denkmeier et al. | |

FOREIGN PATENT DOCUMENTS

| | | | |
|---|---|---|---|
| AT | 511 591 | B1 | 1/2013 |
| AT | 515 526 | B1 | 10/2015 |
| CN | 1161267 | A | 10/1997 |
| CN | 102371499 | A | 3/2012 |
| CN | 102975193 | A | 3/2013 |
| EP | 2 913 114 | A1 | 9/2015 |
| JP | 2004337950 | A * | 12/2004 |
| JP | 2005-074446 | A | 3/2005 |
| WO | 2013/166538 | A1 | 11/2013 |
| WO | 2016/023057 | A1 | 2/2016 |

* cited by examiner 6
5
79
17
22
27
78
18
21

GRIPPER SYSTEM FOR A BENDING PRESS

CROSS REFERENCE TO RELATED APPLICATIONS

This application is the National Stage of PCT/EP2016/076585 filed on Nov. 3, 2016, which claims priority under 35 U.S.C. § 119 of Austrian Application No. A 50937/2015 filed on Nov. 4, 2015, the disclosure of which is incorporated by reference. The international application under PCT article 21(2) was not published in English.

BACKGROUND OF THE INVENTION

1. Field of the Invention

The invention relates to a gripper system for a bending press, and a bending press equipped therewith.

2. Description of the Related Art

A tool changing system is known from AT 511 078 B1, whereby the tool change is implemented using the backgauge.

The disadvantage of the tool changing system known from AT 511 078 B1 is that the backgauge is not ideally suited to changing a tool due to the need for accuracy.

Other tool changing systems are known from EP 2 913 114 A1, JP 2005 07446 A, AT 508 923 A4, AT 515 526 B1 and WO2013/166538 A1.

SUMMARY OF THE INVENTION

The underlying objective of this invention is to propose an improved tool changing system by means of which the tool change can be implemented as quickly as possible.

This objective is achieved by the according to the invention.

The invention proposes a gripper system for a press brake having a gripping device for manipulating a bending tool. The gripping device comprises a first gripping arm and a second gripping arm that is displaceable in the clamping direction relative to the first gripping arm, said gripping arms being configured to engage in a gripping groove of a bending tool and to clamp the bending tool. The gripping device is arranged on a carriage system, said carriage system comprising a horizontal linear guide by means of which the gripping device is displaceable towards the gripping groove or away from the gripping groove in the longitudinal direction of the gripping arms.

The advantage of the design of gripper system proposed by the invention is that the gripping device can be held and guided by the carriage system and in particular a bending tool can be inserted in the tool holder by the gripper system in as short a time as possible. Non-productive time, in particular time spent setting up the bending machine, can be kept as short as possible.

It may also be expedient if two of the horizontal linear guides are disposed on the vertical linear guide, each of which is provided with a gripping device. The advantage of this is that a separate gripping device is provided for bending tools that are inserted in the top press beam and for bending tools that are inserted in the bottom press beam. This enables the top press beam and bottom press beam to be set up synchronously, thereby further reducing non-productive time.

Furthermore, the vertical linear guide may be disposed on another horizontal linear guide by means of which the gripping device can be moved in the horizontal direction of movement of a tool holder of the press brake. The advantage of this is that the bending tools can be positioned in different positions in the longitudinal direction of the tool holder by means of the other horizontal linear guide.

The horizontal linear guide may also comprise a guide carriage guided on a guide rail on which the gripping device is received and the guide carriage can be positioned by means of an actuator, preferably a pneumatic cylinder, between an extracted inserting position and a retracted inoperative position. The advantage of this is that by opting for such an arrangement, the gripping device can be disposed on the guide carriage, thereby enabling the gripping device to be extracted and/or retracted.

Also of advantage is a feature whereby a cylinder of the pneumatic cylinder is coupled with the guide rail and a piston rod of the pneumatic cylinder is coupled with the guide carriage. In particular, the pneumatic cylinder is oriented so as to achieve the most effective functionality possible of the gripper system.

Based on another embodiment, it is possible for another actuator to be disposed between the guide rail and the pneumatic cylinder by means of which the pneumatic cylinder can be moved and thus enable the extracted inserting position of the pneumatic cylinder to be varied. The advantage of this is that the gripper system can be adapted to different bending tools. In particular, adapting the inserting position means that the pneumatic cylinder provided as a means of moving the gripping device between the inserting position and inoperative position only has to be moved into these two positions. The pneumatic cylinder can therefore be made to the simplest possible design and/or be capable of a high travel speed.

It may also be expedient if the cylinder of the pneumatic cylinder is disposed on a positioning carriage which can be moved horizontally relative to the vertical linear guide by means of the other actuator. The advantage of this is that it imparts a certain degree of stability to the gripper system to enable exact positioning of the gripping device.

Furthermore, the other actuator may be provided in the form of a servomotor which can be steplessly displaced between a minimum position and a maximum position. The advantage of this is that the gripper system makes it possible not only to adapt to two different bending tools but to an unlimited number of different bending tools.

A lock mechanism may also be provided by means of which the position of the cylinder of the pneumatic cylinder, which can be set by means of the other actuator, can be fixed. The advantage of this is that the position of the extracted inserting position and/or retracted inoperative position can be fixed in order to achieve a high repeatability. Furthermore, the pneumatic cylinder may be moved at higher travel speeds and because of the lock mechanism, the forces which occur due to the inertia of the gripping device at high travel speeds do not have to be absorbed by the other actuator. This being the case, the other actuator, which is primarily configured to set the end positions and must therefore have a high positioning accuracy, may have only a low actuating force. In particular, this means that the other actuator may be as small as possible and also as cost-effective as possible.

Based on one particular feature, the lock mechanism may comprise a locking pin which can be moved by means of a lock cylinder and the locking pin has a toothed surface on its end face and co-operates with a toothed rack, and when the lock cylinder is in the extracted state, the toothed surface engages in the toothed rack. The advantage of this is that such a locking pin can be provided in the gripper system without requiring a lot of space. Due to the toothed surface of the locking pin and the engagement of the locking pin in a co-operating toothed rack, a positive connection can be established between the locking pin and toothed rack thereby enabling a high retaining force to be applied by the lock mechanism.

BRIEF DESCRIPTION OF THE DRAWINGS

To provide a clearer understanding, the invention will be described in more detail below with reference to the appended drawings.

These are highly simplified, schematic diagrams illustrating the following.

DETAILED DESCRIPTION OF THE PREFERRED EMBODIMENTS

Figure 1:
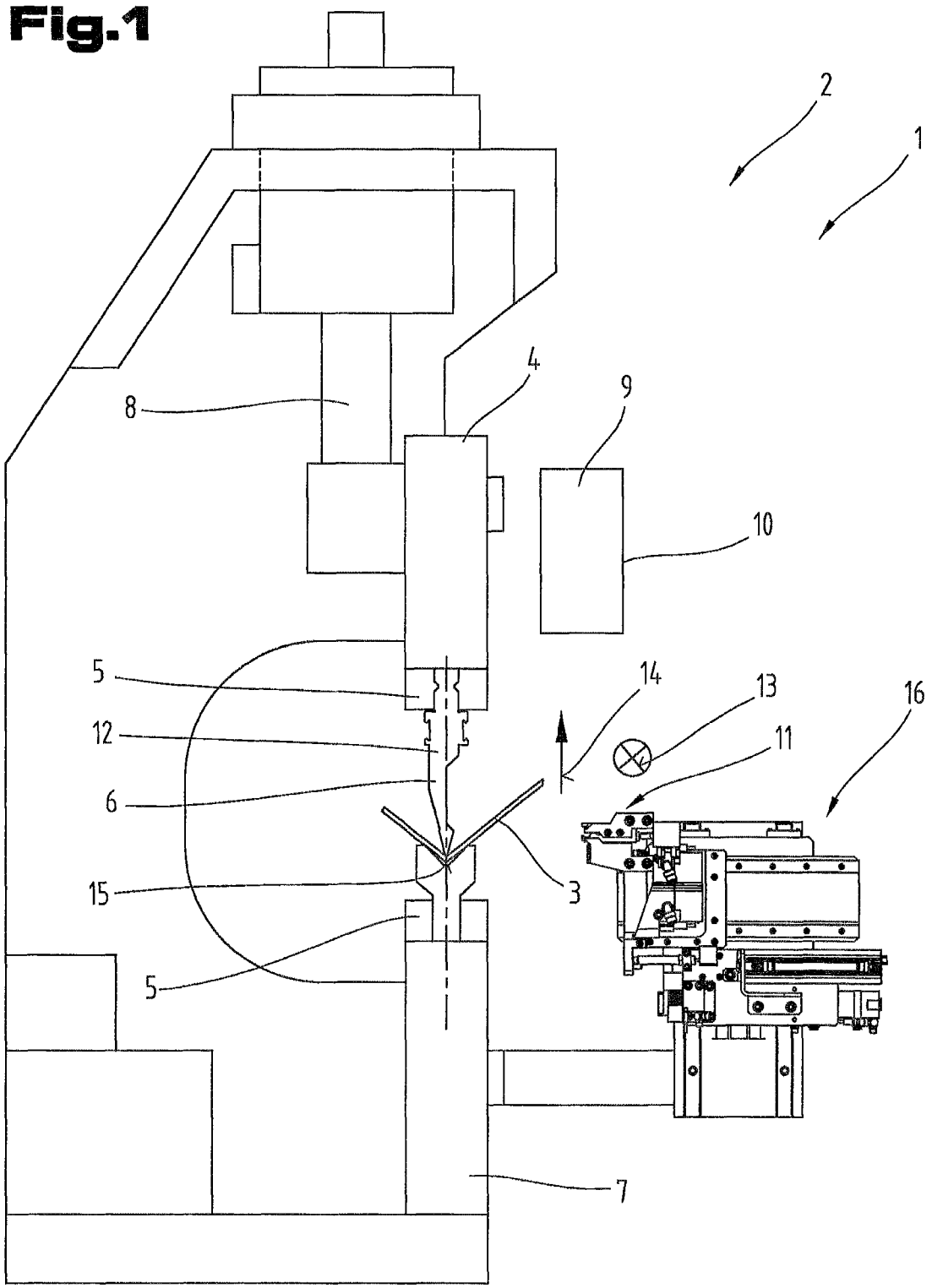
FIG. 1 a side view of a schematically illustrated processing system.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIG. 1 is a schematic diagram illustrating the side view of a processing system 1. The processing system 1 comprises a press brake 2 provided as a means of bending a metal sheet 3.

The press brake 2 further comprises a first displaceable press beam 4 in which a tool holder 5 for holding a first bending tool 6 is disposed. The press brake 2 also comprises a second stationary press beam 7 on which a tool holder 5 for holding a bending tool 6 is likewise disposed.

The metal sheet 3 to be bent is placed between the bending tools 6 of the first 4 and second press beam 7 for the bending operation. The bending tool 6 secured in the first press beam 4 respectively the first displaceable press beam 4 is moved up and/or down in the vertical direction by means of a press drive unit 8. In order to control the press drive unit 8, a computer unit 9 is provided, which can be connected to an input and/or display unit 10.

As illustrated in FIG. 1, the processing system 1 may comprise a gripping device 11 which is used to manipulate the bending tool 6.

As may also be seen from FIG. 1, the bending tool 6 has a tool body 12 which deforms during the operation of bending the metal sheet 3 to be bent. The bending tool 6 can be positioned in the tool holder 5 in the horizontal direction of movement 13 along the clamping portion of the tool holder 5. To this end, the bending tool 6 must be pushed into the tool holder 5 of the press beam 4 in the horizontal direction of movement 13 from the side.

As an alternative to this, another option is to introduce the bending tool 6 into the tool holder 5 in the vertical insertion direction 14. If opting for this way of introducing the bending tool 6 into the tool holder 5, the bending tool 6 must have an insertion mechanism.

A number of bending tools 6 which are of the same type can be positioned in the tool holder 5 adjacent to one another and adjoining one another. As a result, bending edges 15 of individual bending tools 6 form a correspondingly long processing edge.

Another possible way of arranging bending tools 6 is to position a number of different bending tools 6 in the tool holder 5. These different bending tools 6 are then used for different bending operations and can also be individually changed. If bending tools 6 of a different type are used for different process steps, it is standard practice for them to be disposed at a certain distance from one another.

In order to provide a processing system 1 that is as flexible as possible, it is necessary to be able to clamp the bending tools 6 in the tool holder 5 and take them out again easily and quickly.

As may be clearly seen from FIG. 1, the gripping device 11 is disposed on a gripper system 16. The gripper system 16 may be connected to the second press beam 7 for example. In this context, it is conceivable for the gripper system 16 to be disposed on the external face of the press beam 7, as is the case in FIG. 1. However, for reasons of space and to improve operability of the bending machine, it may be that the gripper system 16 is disposed on the internal face of the press beam 7.

Figure 2:
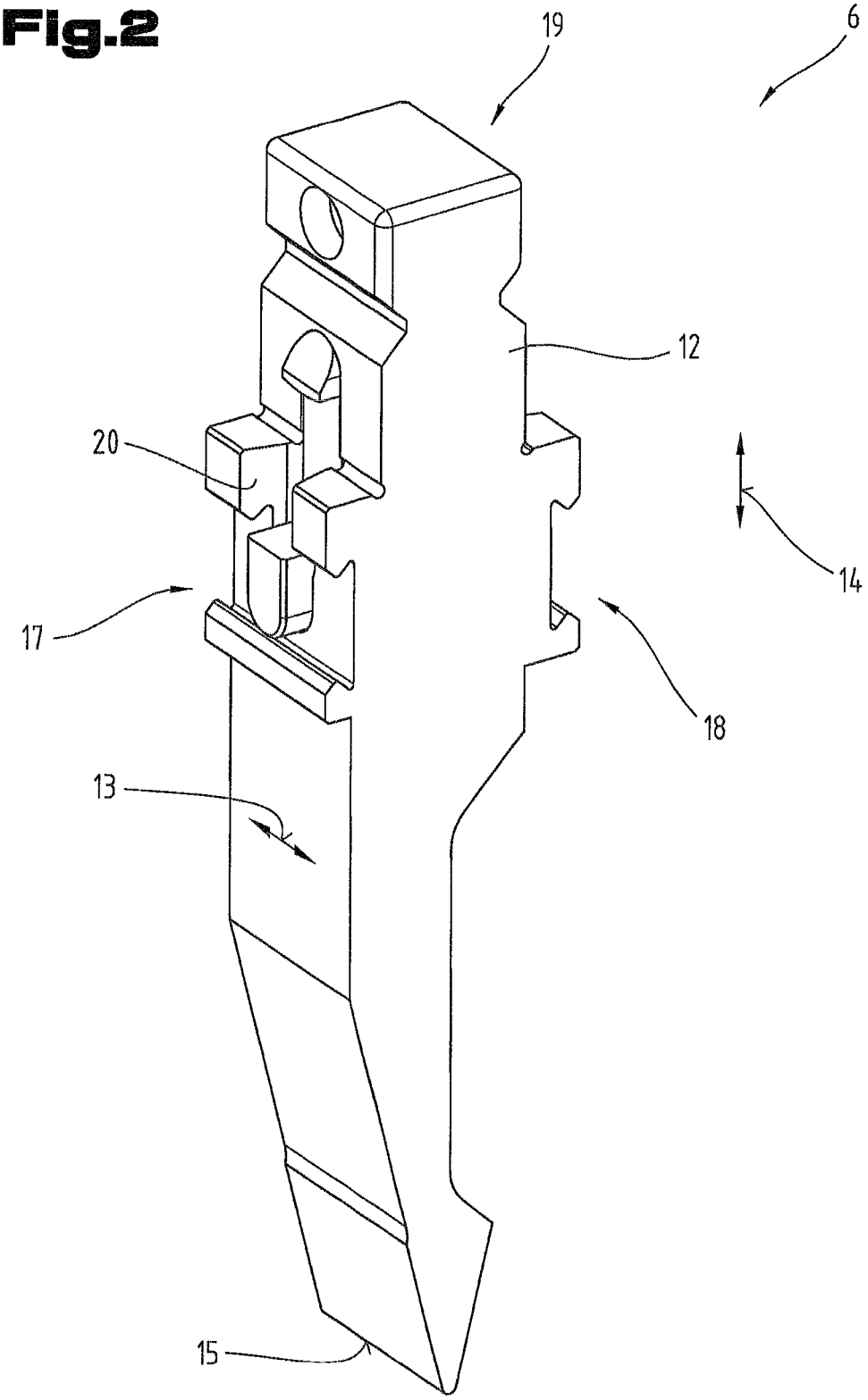
FIG. 2 a perspective view of a bending tool.

FIG. 2 is a perspective view illustrating the bending tool 6. As clearly illustrated, the main component of the bending tool 6 is the tool body 12.

The tool body 12 may also have a first gripping groove 17 and a second gripping groove 18 which are provided in the tool body 12. The gripping grooves 17, 18 may be disposed opposite one another on the tool body 12 and extend in a longitudinal direction parallel with the bending edge 15. The gripping grooves 17, 18 are shaped in such a way that when bending tools are being changed, the gripping device 11 is able to locate in them and thus set up the bending tool 6 on the press brake 2 and take it out again as and when necessary.

However, it is not absolutely necessary for the gripping grooves 17, 18 to be provided in the form of a groove as such and instead, it is also conceivable to provide them in the form of simple bores in which a gripping device 11 can engage.

The bending tool 6 can be picked up by the gripping device 11 selectively by the first gripping groove 17 or by the second gripping groove 18.

The bending tool 6 also has a holder portion 19 which is inserted in the tool holder 5. As a result, the bending tool 6 is retained in the press brake 2.

Figure 3:
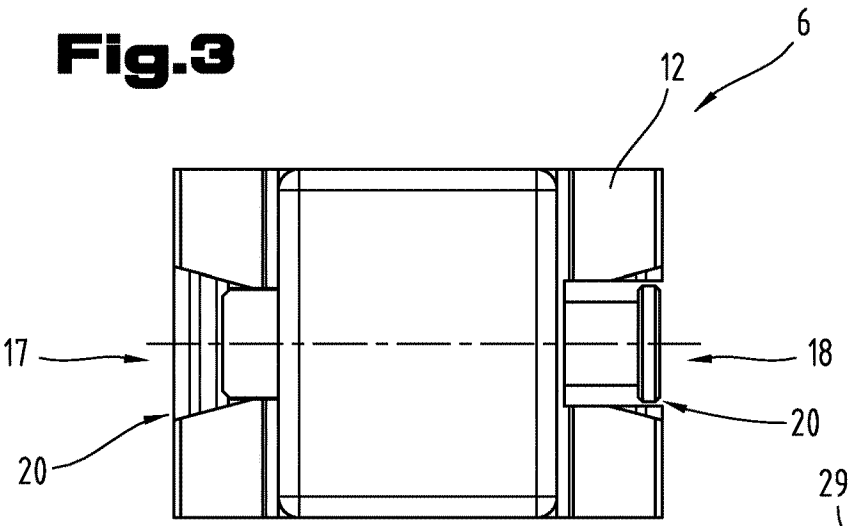
FIG. 3 a plan view of the bending tool.

FIG. 3 shows a plan view of the bending tool and as may clearly be seen in conjunction with FIG. 2, a centering recess 20 may be provided in the tool body 12 both in the region of the first gripping groove 17 and in the region of the second gripping groove 18. The centering recess 20 makes it easier for the bending tool 6 to be retained by the gripping device 11. In particular, the centering recess 20 makes it easier to position the bending tool 6 correctly relative to the gripping device 11.

Figure 5:
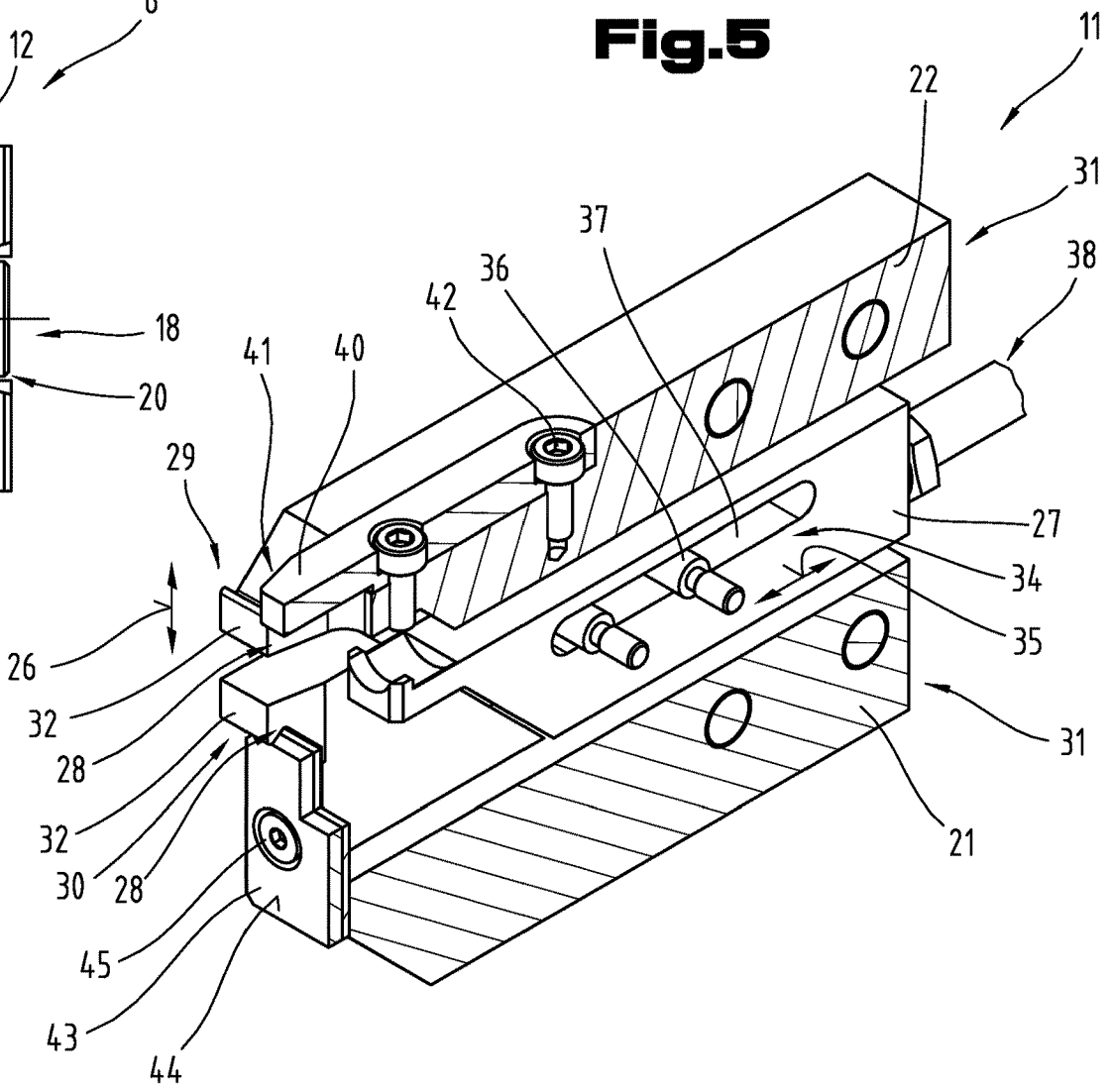
FIG. 5 a perspective view of the gripping device seen in half-section.
Figure 4:
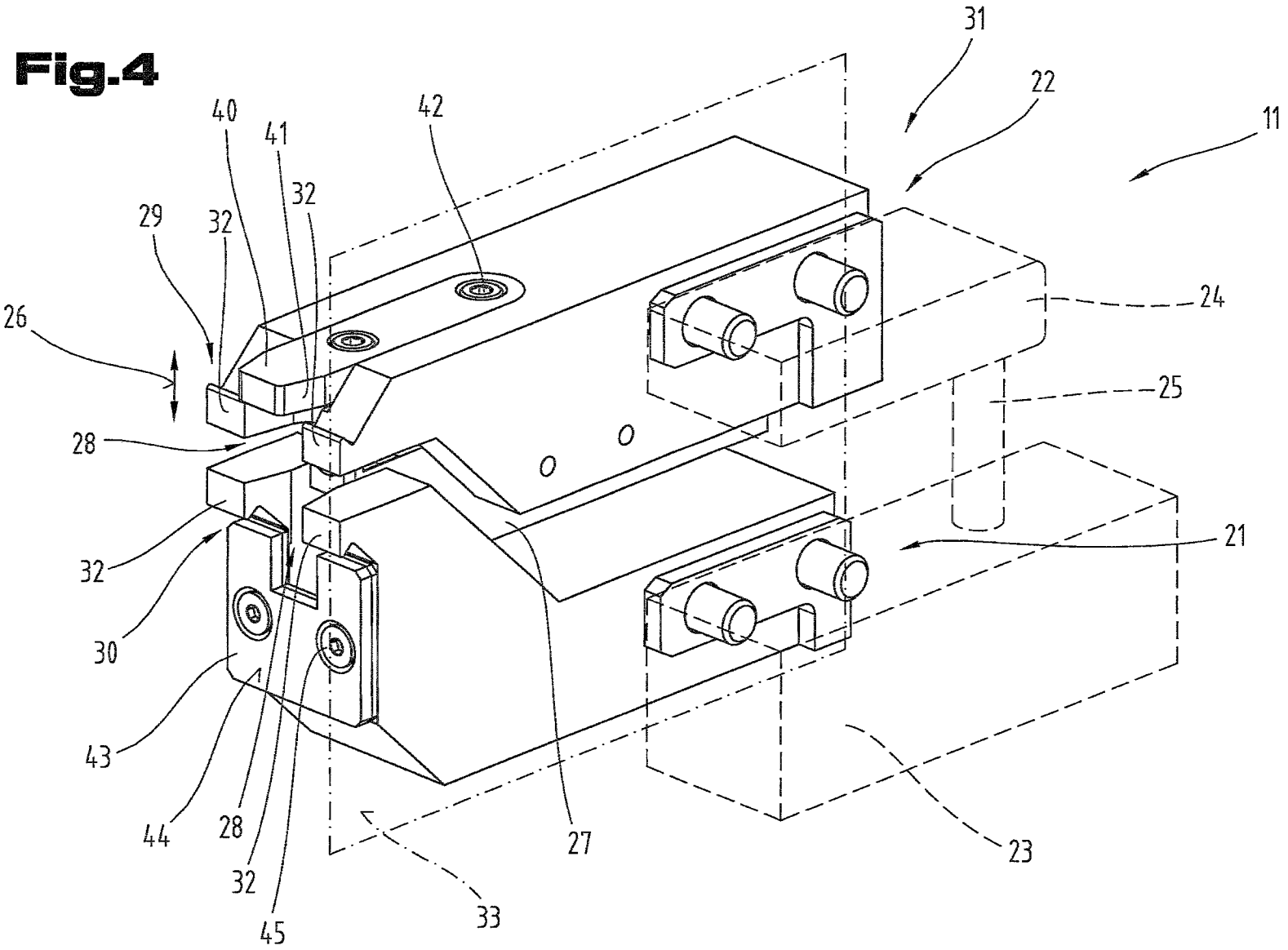
FIG. 4 a perspective view of a gripping device for manipulating the bending tool.
Figure 6:
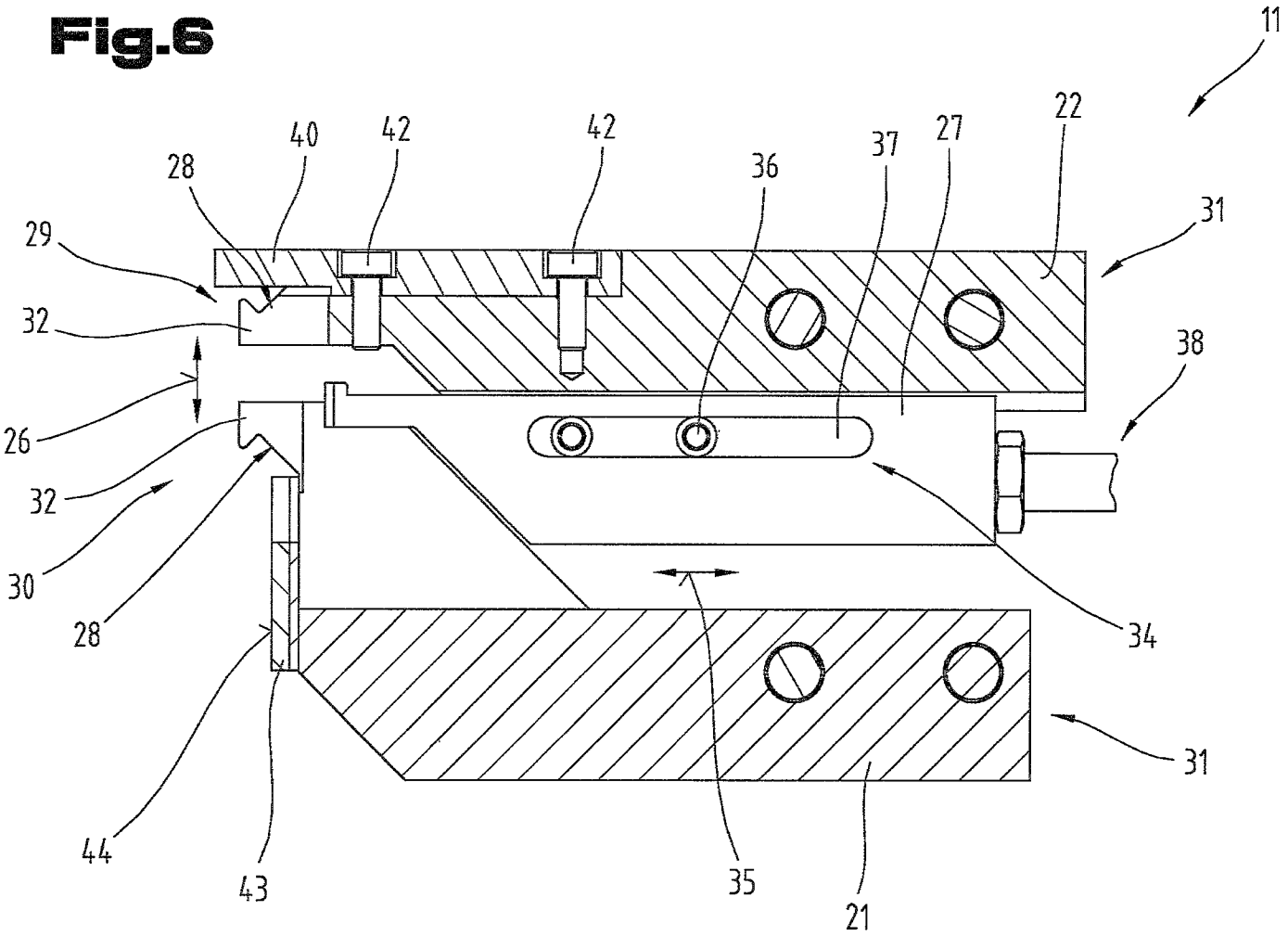
FIG. 6 a diagram of the gripping device seen in half-section.

FIGS. 4 to 6 illustrate different views of an exemplary embodiment of a gripping device 11, the same reference numbers and component names being used to denote parts that are the same as those described in connection with the preceding drawings. To avoid unnecessary repetition, reference may be made to the more detailed descriptions of these drawings given above.

FIG. 4 is a perspective view of the gripping device 11 which is configured to manipulate the bending tool 6, in particular to insert the bending tool 6 in the tool holder 5 and to remove the bending tool 6 from the tool holder 5.

FIG. 5 also shows a perspective view of the gripping device 11 but in this instance in the form of a half-section to provide a view of parts on the inside.

FIG. 6 shows a half-section of the gripping device 11.

The design of the gripping device 11 will be described and explained with reference to FIG. 4, FIG. 5 and FIG. 6 together.

As may be seen from FIG. 4, the gripping device 11 has a first gripping arm 21 and a second gripping arm 22. The first gripping arm 21 is disposed on a first gripping arm holder 23 and the second gripping arm 22 is disposed on a second gripping arm holder 24. In this context, the second gripping arm holder 24 may have a first actuator 25 by means of which the second gripping arm 22 can be moved in a clamping direction 26 relative to the first gripping arm 21. In other words, the two gripping arms 21, 22 can be moved towards one another or moved away from one another by means of the first actuator 25.

Based on an alternative variant, the actuator 25 may also act on both gripping arms 21, 22 and the latter are moved symmetrically towards one another or apart from one another by the actuator 25.

Furthermore, the gripping device 11 may have an unlocking element 27 which is received between the two gripping arms 21, 22. A recess 28 may be provided on both the first gripping arm 21 and the second gripping arm 22 and the unlocking element 27 can be moved in the gap created by the recess 28. The recess 28 may extend from a gripping portion 29 or a front end portion 30 as far as a rear gripping arm region 31.

In particular, two gripping fingers 32 may be formed respectively on the gripping portion 29 by the recess 28 in the gripping arms 21, 22. As may be seen particularly clearly from FIG. 6, the gripping fingers 32 are of a dovetail shape to enable them to engage in the first gripping groove 17 or in the second gripping groove 18 of the bending tool 6. Since the second gripping arm 22 can be moved in the clamping direction 26 relative to the first gripping arm 21, the bending tool 6 can thus be selectively gripped or released again. Furthermore, the first gripping arm 21 and/or the second gripping arm 22 may be of a substantially symmetrical design by reference to a center plane 33 and the two gripping fingers 32 of a gripping arm 21, 22 are each disposed at the same distance from the center plane 33 and the recess 28 is disposed exactly in the middle on the center plane 33.

Furthermore, the unlocking element 27 may be mounted on the second gripping arm 22 by means of a non-rotating longitudinal guide 34 so that it can be moved in the longitudinal direction 35 relative to the first gripping arm 21 and/or to the second gripping arm 22. The non-rotating longitudinal guide 34 may be provided by means of two guide bolts 36 which extend transversely through the second gripping arm 22 and co-operate with a slot 37 in the unlocking element 27. In addition, the gripping device 11 may comprise a second actuator 38 by means of which the unlocking element 27 can be moved in a direction of movement 35 relative to the second gripping arm 22.

Both the first actuator 25 and the second actuator 38 may be provided in the form of a pneumatic or hydraulic cylinder, for example. Alternatively, it is also conceivable to use an electric control cylinder or a linear motor as the actuator for example.

The unlocking element 27 is configured to enable operation of an operating element of the bending tool 6 and thus enable the bending tool 6 to be inserted in a vertical insertion direction 14 into the tool holder 5 and taken back out of it again.

As may be seen particularly clearly from FIG. 6, a centering projection 40 is provided on the second gripping arm 22, in particular in the gripping portion 29, which is able to engage in the centering recess 20 of the bending tool 6. As a result of this, the bending tool 6 can be positioned relative to the gripping device 11. The centering projection 40 is preferably designed so that it has a chamfer 41 on both sides which matches the wider region in the centering recess 20. The centering projection 40 may also be provided in the form of a flat bar with corresponding chamfers and is attached to the second gripping arm by means of a fixing means 42.

Another option is one where the gripping device 11 comprises a wear protection element 43 disposed in the front end region 30 of the first gripping arm 21. The wear protection element 43 has a surface 44. The wear protection element 43 may also be attached to the first gripping arm 21 by means of fixing means 45. The wear protection element 43 may be made from a synthetic material, in particular rubber material, and thus act as a damper.

Figure 7:
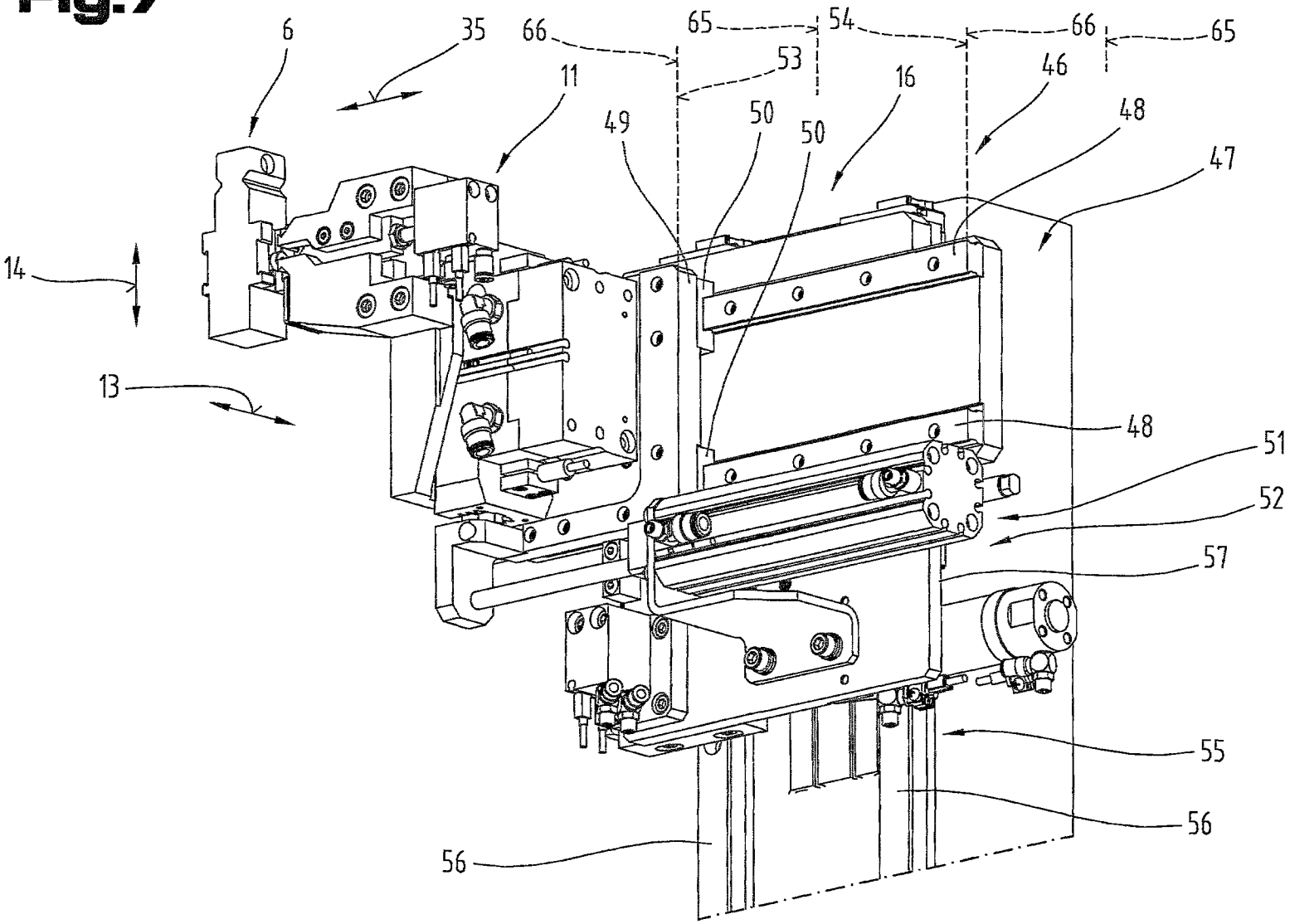
FIG. 7 a perspective view of the gripper system seen from a first angle.
Figure 8:
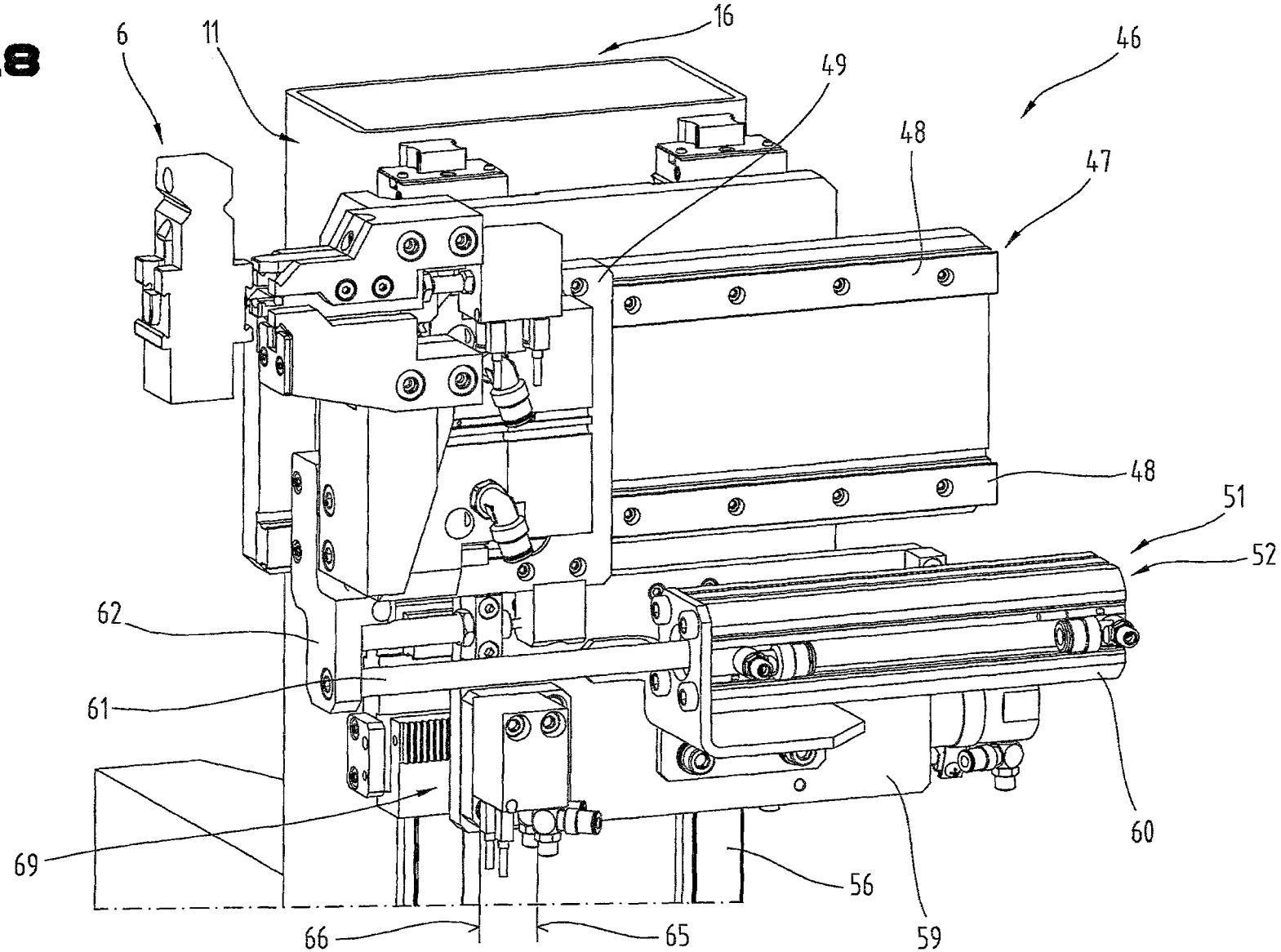
FIG. 8 a perspective view of the gripper system seen from a second angle.
Figure 9:
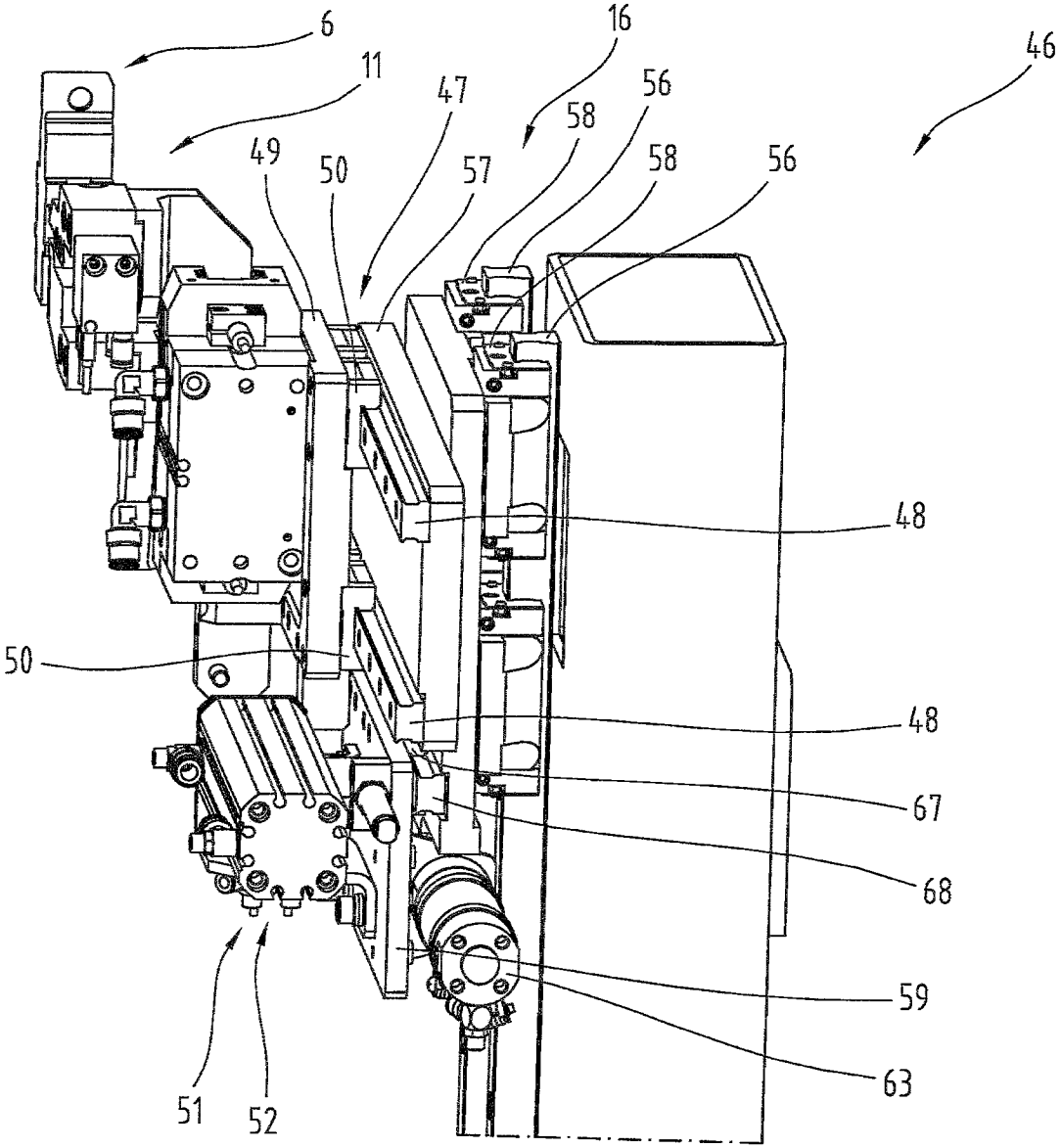
FIG. 9 a perspective view of the gripper system seen from a third angle.

FIGS. 7 to 9 illustrate a carriage system 46 of the gripper system 16 in a perspective view from different angles respectively, the same reference numbers and component names being used to denote parts that are the same as those described in connection with the preceding drawings. To avoid unnecessary repetition, reference may be made to the more detailed descriptions of these drawings given above.

The carriage system 46 is used to manipulate the gripping device 11. The following description of the design of the carriage system 46 of the gripping device 11 will be given with reference to FIGS. 7 to 9 together.

The carriage system 46 comprises a horizontal linear guide 47 on which the gripper system 16 is disposed. The horizontal linear guide 47 may have one or preferably two guide rails 48 on which a guide carriage 49 is mounted so as to be horizontally displaceable. In the embodiment illustrated as an example here, the horizontal linear guide 47 comprises two guide rails 48 and two rail supports 50 matching them are provided in the guide carriage 49. By providing two mutually spaced guide rails 48 and rail supports 50, a higher bending moment can be transmitted by the guide carriage 49 and the stability of the carriage system 46 thus increased as a result. The rail support 50 is guided in the guide rail 48 in a positive fit. It is possible for the rail support 50 to be guided in the guide rail 48 using ball bearings for mounting purposes. Based on another alternative embodiment, it is conceivable to provide a sliding guide between the rail support 50 and guide rail 48.

Due to the horizontal linear guide 47, the gripping device 11 can be moved in the longitudinal direction 35 of the gripping arms 21, 22. The gripping device 11 can therefore be moved towards the bending tool 6 inserted in the tool holder 5 or away from it. In particular in this context, the gripping device 11 may be disposed directly on the guide carriage 49 and connected to it by means of fixing means, such as screws.

An actuator 51 may also be provided, which moves the guide carriage 49 in the longitudinal direction 35 of the gripping arms 21, 22. The actuator 51 may be provided in the form of a motorized electric drive, a motorized electric spindle drive, a hydraulic cylinder and such like. In the case of the embodiment illustrated as an example here, the actuator 51 is provided in the form of a pneumatic cylinder 52. By means of the pneumatic cylinder 52, the gripping device 11 can be moved into an extracted inserting position 53 and a retracted inoperative position 54. The pneumatic cylinder 52 is configured in particular to enable the gripping device 11 to be moved between these two positions as quickly as possible.

The extracted inserting position 53 is the position in which the bending tool can be inserted in the tool holder 5 in the vertical insertion direction 14.

When the gripping device 11 is in the retracted inoperative position 54, the bending tool 6 can be moved in the horizontal direction of movement 13 alongside the other bending tools 6 retained in the tool holder 5.

The carriage system 46 may also comprise a vertical linear guide 55 by means of which the gripping device 11 respectively the horizontal linear guide 47 can be moved in the vertical insertion direction 14. As is the case with the horizontal linear guide 47 already described, the vertical linear guide 55 may have one or more guide rails 56 on which a guide carriage 57 is guided. As is the case with the embodiment already described, the guide carriage 57 may have one or more rail supports 58 which co-operate with the guide rails 56.

In particular, the guide rails 48 of the horizontal linear guide 47 may be disposed on the guide carriage 57 of the vertical linear guide 55, thereby enabling them to be moved vertically.

Based on the embodiment illustrated here, an actuator support 59 may also be provided as a means of receiving the actuator 51, in particular the pneumatic cylinder 52. In particular, a cylinder 60 of the pneumatic cylinder 52 may be secured to the actuator support 59. The piston rod 61 of the pneumatic cylinder 52 may be coupled with the guide carriage 49 of the horizontal linear guide 47 by means of a mounting support 62.

Another actuator 63 may also be provided, which is coupled with the guide carriage 57 of the vertical linear guide 55 and with the actuator support 59. This being the case, the actuator support 59 can be moved in the longitudinal direction 35 of the gripping fingers 21, 22. The entire actuator 51 can therefore be moved in the longitudinal direction 35, thereby enabling the inserting position 53 to be varied between a minimum position 65 and a maximum position 66.

The actuator support 59 may also be provided in the form of a positioning carriage and, like the carriage systems already described, a carriage support 67 guided in a guide rail 68 may be provided on the positioning carriage 64. The other actuator 63 is preferably provided in the form of a positioning cylinder, for example in the form of an electric spindle drive. The other actuator 63 is preferably configured to enable the positioning carriage 64 respectively the actuator support 59 to be moved steplessly between the minimum position 65 and the maximum position 66.

A lock mechanism 69 may also be provided, by means of which the position of the positioning carriage 64 respectively the actuator support 59 can be fixed. Due to the lock mechanism 69, therefore, any force which might occur oriented in the longitudinal direction 35 does not have to be absorbed by the other actuator 63. Such a force might occur due to the inertia of the gripping device 11 and the guide carriage 49 of the horizontal linear guide 47 for example, especially at high travel speeds.

The movement system by means of the other actuator 63 offers a particular advantage in that the inserting position 53 of the gripping device 11 can be adapted to the geometry of the bending tool 4 respectively being inserted and to the geometry of the tool holder 5.

Figure 10:
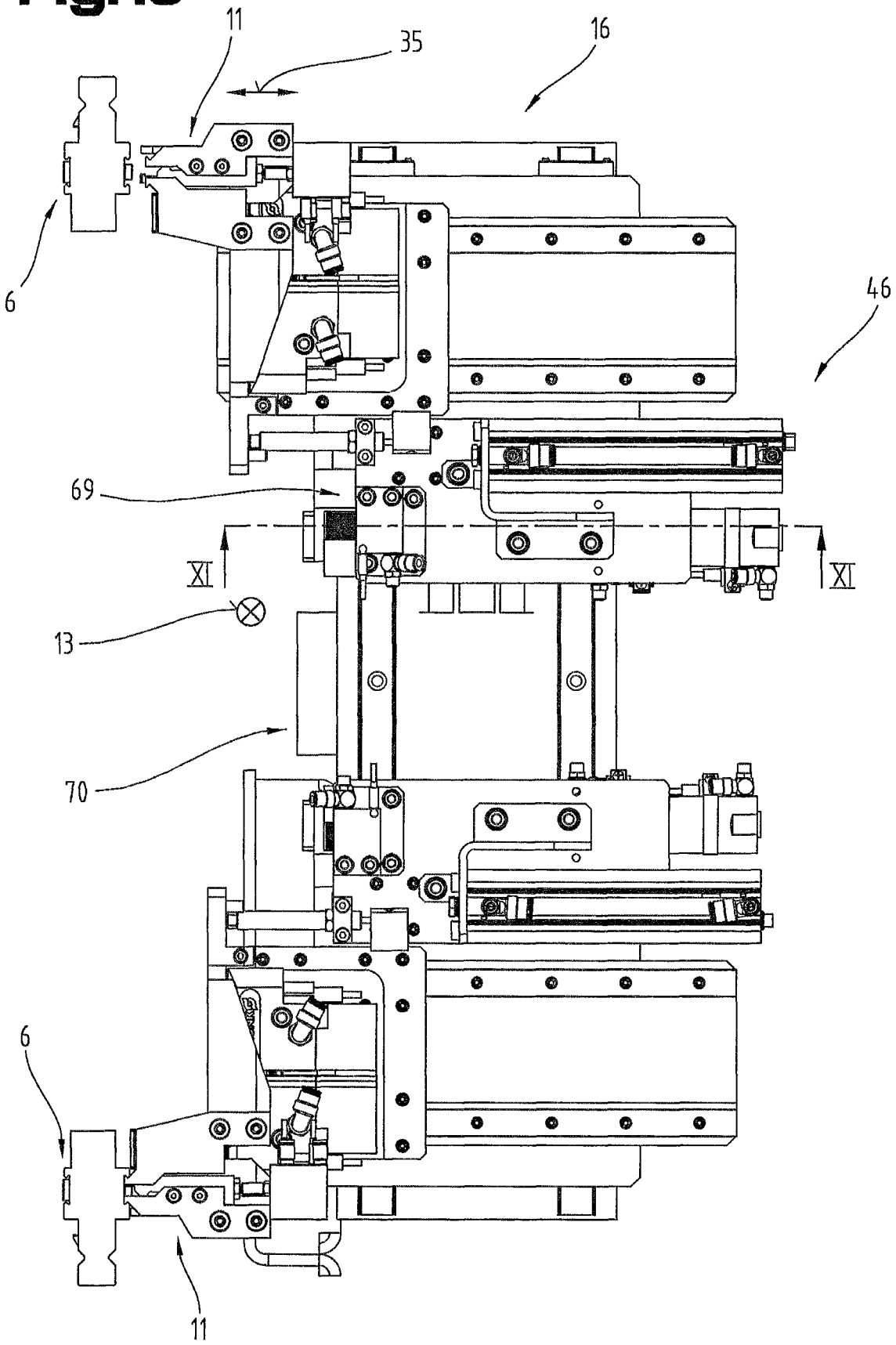
FIG. 10 a front view of the gripper system.

FIG. 10 illustrates the gripper system 16 in a view from the front. As may be seen from FIG. 10, the gripper system 16, in particular the carriage system 46 of the gripper system 16, may have another horizontal linear guide 70 by means of which the vertical linear guide 55 can be moved in the horizontal direction of movement 13. In particular, the horizontal linear guide 47, the vertical linear guide 55 and the other horizontal linear guide 70 may respectively be disposed at a right angle to one another and thus represent the three main axes of a Cartesian coordinate system. As may also be seen from FIG. 10, two of the gripping devices 11 may be provided on the gripper system 16 and a first one of the gripping devices 11 is used for manipulating the top bending tool and a second one of the gripping devices 11 is used for manipulating the bottom bending tool.

Figure 11:
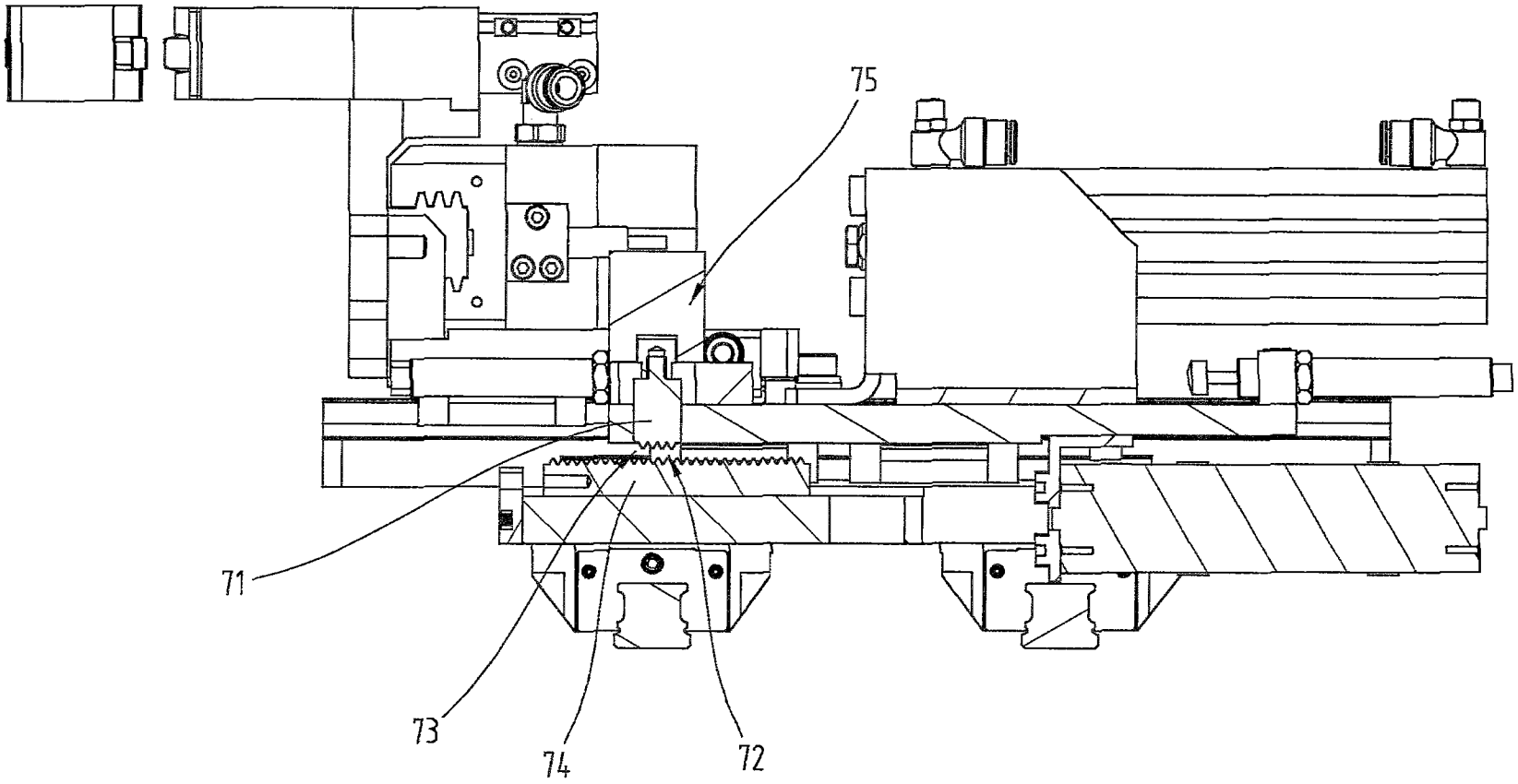
FIG. 11 a diagram in section showing the gripper system along line XI-XI indicated in FIG. 10.

FIG. 11 is a diagram in section illustrating the gripper system 16 along section XI-XI indicated in FIG. 10. As may be seen from FIGS. 10 and 11 together, the lock mechanism 69 may comprise a locking pin 71 having a toothed surface 73 on an end face 72 which is able to co-operate with a toothed rack 74. As a result, when the locking pin 71 is in the extracted state, a positive connection is established between the locking pin 71 and toothed rack 74, thereby enabling the positioning carriage 64 to be locked or secured.

The toothed surface 73 may have toothing of any type. In particular, it seems to be of advantage if the toothed surface 73 has micro-toothing, which theoretically enables each and every position of the positioning carriage 64 to be locked.

In the embodiment illustrated as an example, the locking pin 71 is moved between the releasing position and locking position by means of a lock cylinder 75.

Figure 12:
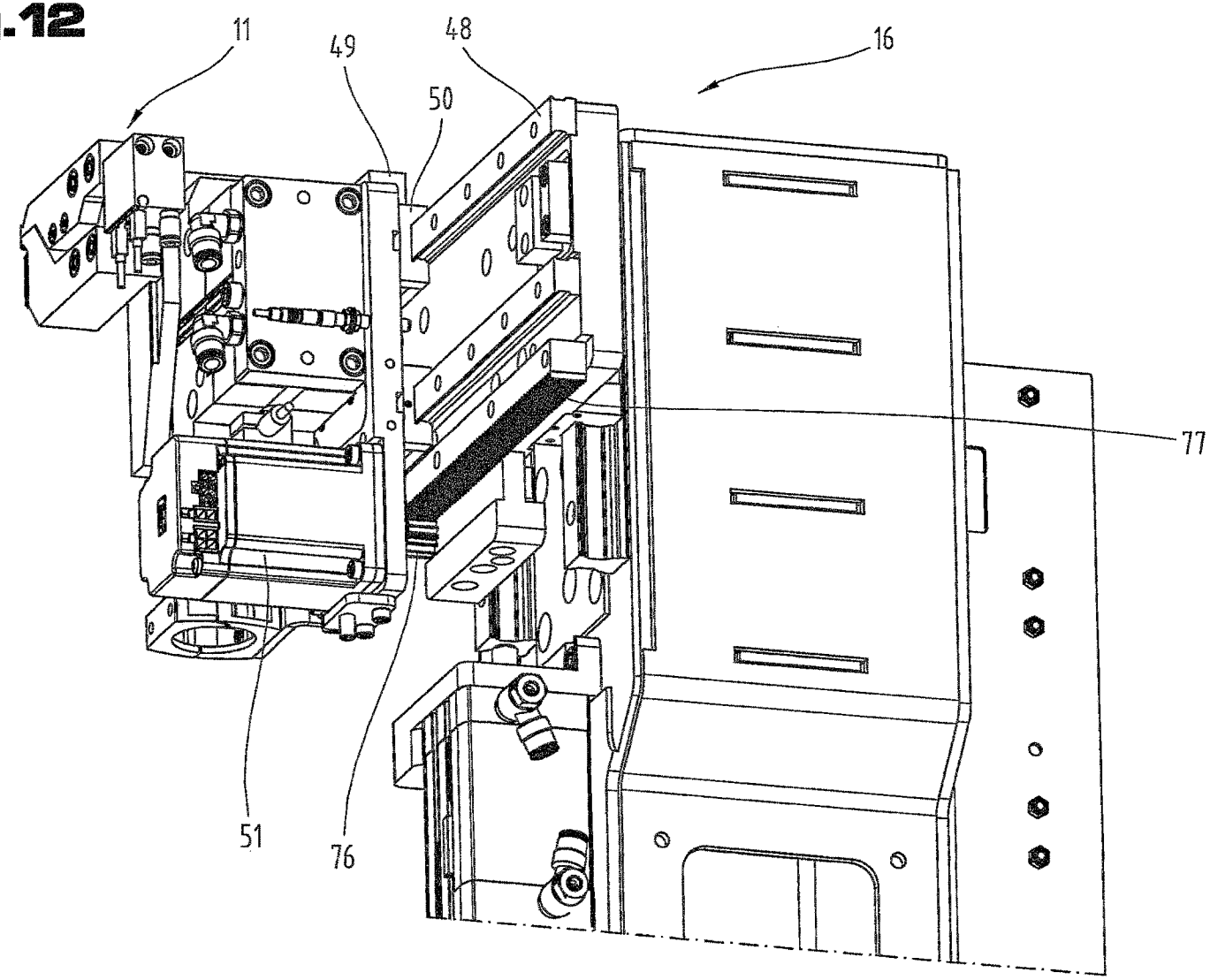
FIG. 12 a perspective view of the gripper system.

FIG. 12 illustrates an example of another embodiment of the gripper system 16. In the embodiment illustrated as an example in FIG. 12, the actuator 51 used to move the guide carriage 49 with the gripping device 11 disposed thereon is provided in the form of an electric motor. Such an electric motor might be a stepper motor or a servomotor for example. This being the case, a gearwheel 76 is provided, which is driven by the electric motor respectively actuator 51.

The gearwheel 76 engages in a toothed rack 77, thereby enabling the guide carriage 49 to be moved. In particular, the actuator 51 may be disposed directly on the guide carriage 49.

FIGS. 13 to 18 show different views illustrating how the bending tool 6 and gripping device 11 proposed by the invention co-operate, the same reference numbers and component names being used to denote parts that are the same as those described in connection with the preceding drawings. To avoid unnecessary repetition, reference may be made to the more detailed descriptions of these drawings given above.

The centering projection 40 is configured so as to co-operate with the centering recess 20 and thus enables the bending tool 6 to be positioned in the horizontal direction of movement 13 relative to the gripping device 11.

Figure 13:
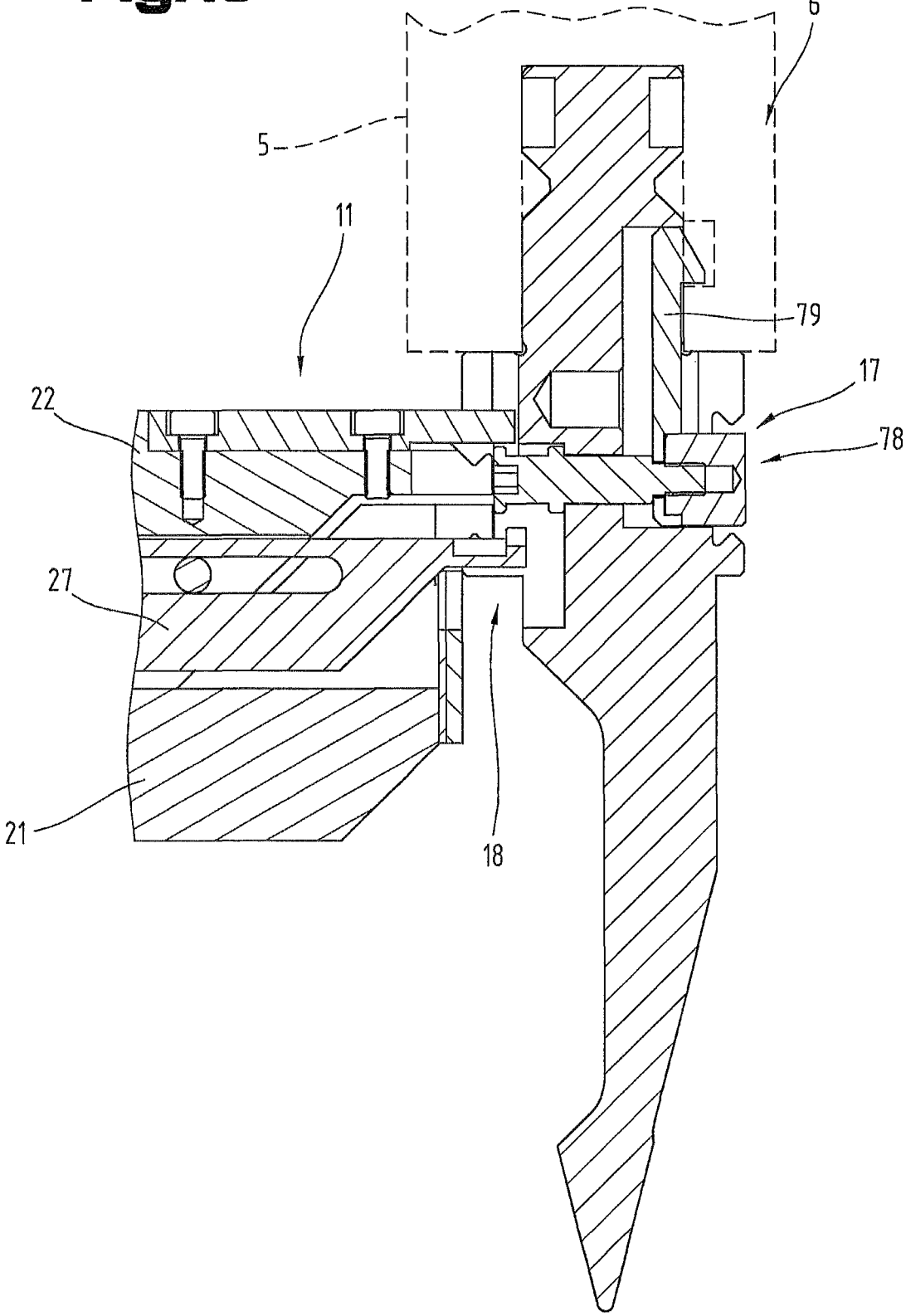
FIG. 13 a view of the gripping device with bending tool seen in section, in which the gripping device is positioned on the second gripping groove in holding step one.
Figure 14:
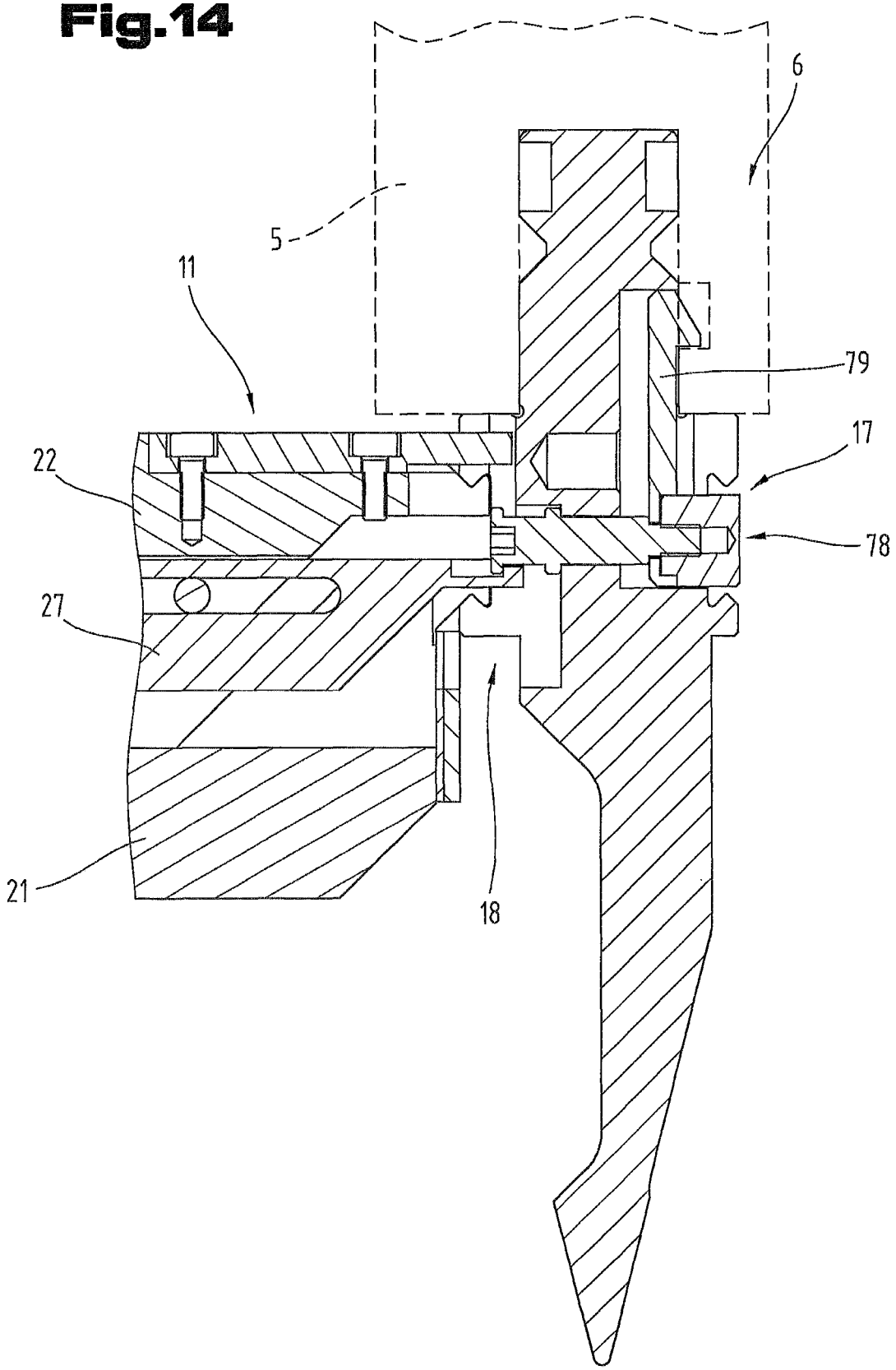
FIG. 14 a view of the gripping device with bending tool seen in section, in which the gripping device is positioned on the second gripping groove in holding step two.
Figure 15:
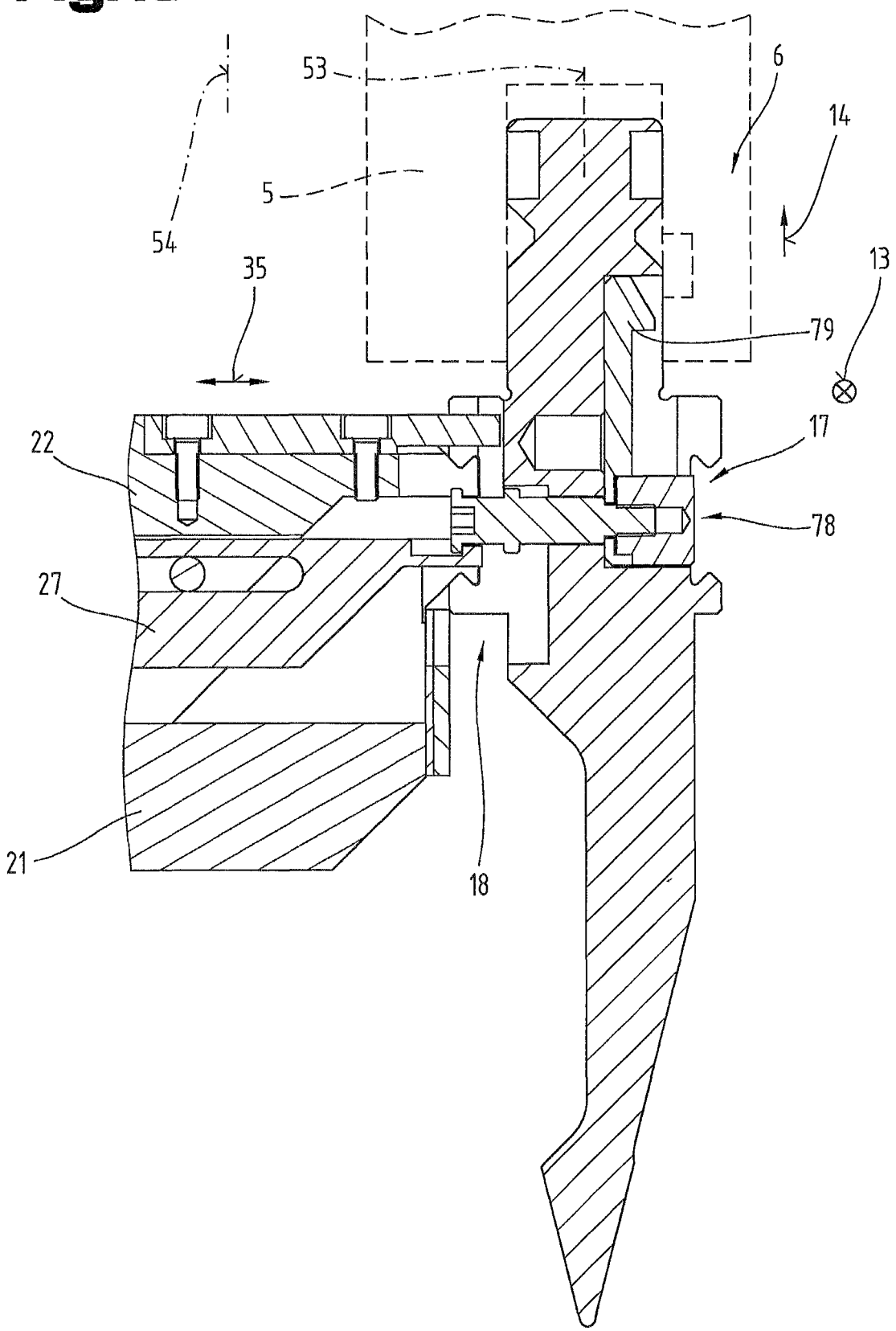
FIG. 15 a view of the gripping device with bending tool seen in section, in which the gripping device is positioned on the second gripping groove in holding step three.

FIGS. 13 to 15 illustrate in a side view the method sequence whereby the bending tool 6 is picked up by the gripping device 11 in steps, which will be explained below in steps.

In a first method step, the gripping device 11 is moved towards the bending tool 6 so that the gripping fingers 32 of the first respectively the second gripping arms 21, 22 are positioned inside the second gripping groove 18. The gripping device 11 is then moved downwards by means of the carriage system 46 in a subsequent method step so that the gripping fingers 32 of the first gripping arm 21 sit in engagement with the second gripping groove 18 and touch one another.

In another method step illustrated in FIG. 14, the second gripping arm 22 is then moved upwards by means of the first actuator 25 in the clamping direction 26 and is thus moved relative to the first gripping arm 21 so that both the gripping fingers 32 of the first gripping arm 21 and the gripping fingers 32 of the second gripping arm 22 sit in engagement with the second gripping groove 18. As this happens, the unlocking element 27 secured to the second gripping arm 22 is simultaneously moved upwards as well.

Based on an alternative embodiment, the two gripping arms 21, 22 may be positioned centrally in the gripping groove 18 and moved symmetrically apart from one another by means of the first actuator 25.

In another method step illustrated in FIG. 15, the unlocking element 27 can now be pulled away by the second actuator 38 in the direction remote from the bending tool 6 so that an operating element 78 disposed in the bending tool 6 and coupled therewith moves a locking element 79 that is used to lock the bending tool 6 relative to the tool holder 5 out of its locking position into its releasing position.

The bending tool 6 can now be moved opposite the vertical insertion direction 14 freely out of the tool holder 5 and/or can be inserted therein.

The bending tool 6 can then be moved by means of the horizontal linear guide 47 in the longitudinal direction 35 of the gripping arms 21, 22 out of the inserting position 53 into the inoperative position 54 so that it can then be conveyed by means of the other horizontal linear guide 70 in the horizontal direction of movement 13 past the other bending tools 6 to the tool storage.

To set the bending tool 6 down, the operating element 78 can now be moved in the reverse sequence back into its normal position and the gripping device 11 disengaged from the bending tool 6.

Figure 16:
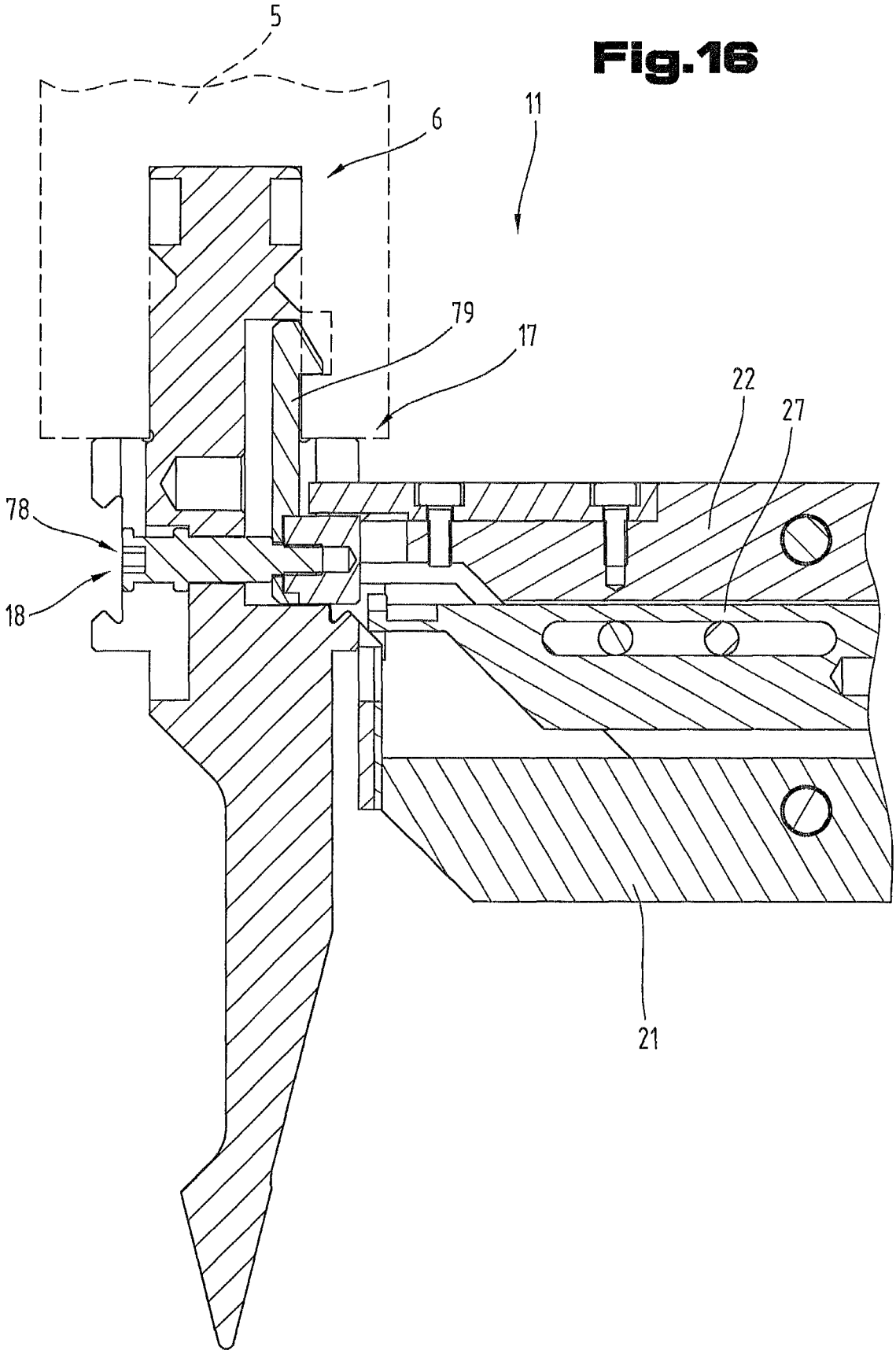
FIG. 16 a view of the gripping device with bending tool seen in section, in which the gripping device is positioned on the first gripping groove in holding step one.
Figure 17:
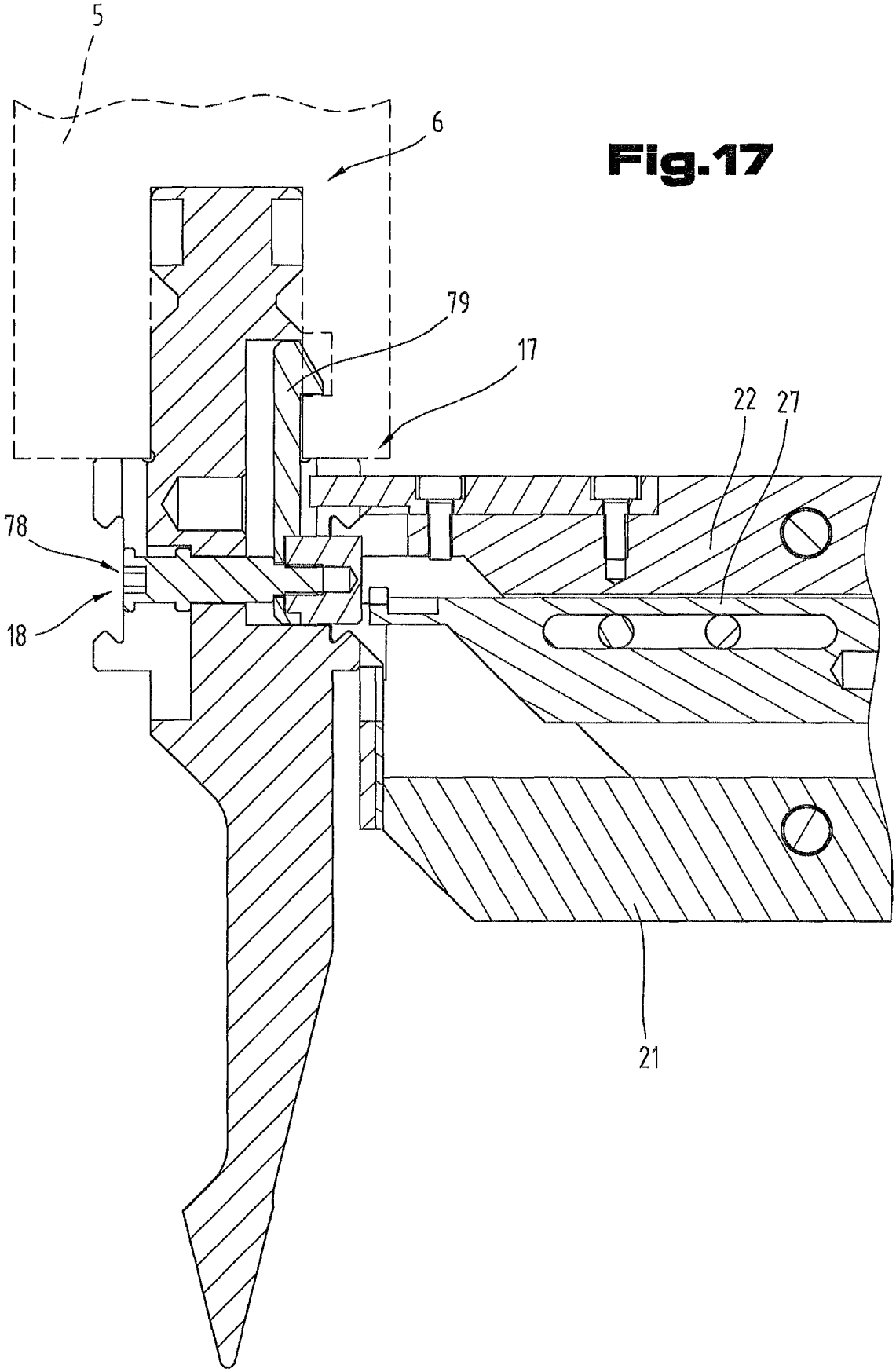
FIG. 17 a view of the gripping device with bending tool seen in section, in which the gripping device is positioned on the first gripping groove in holding step two.
Figure 18:
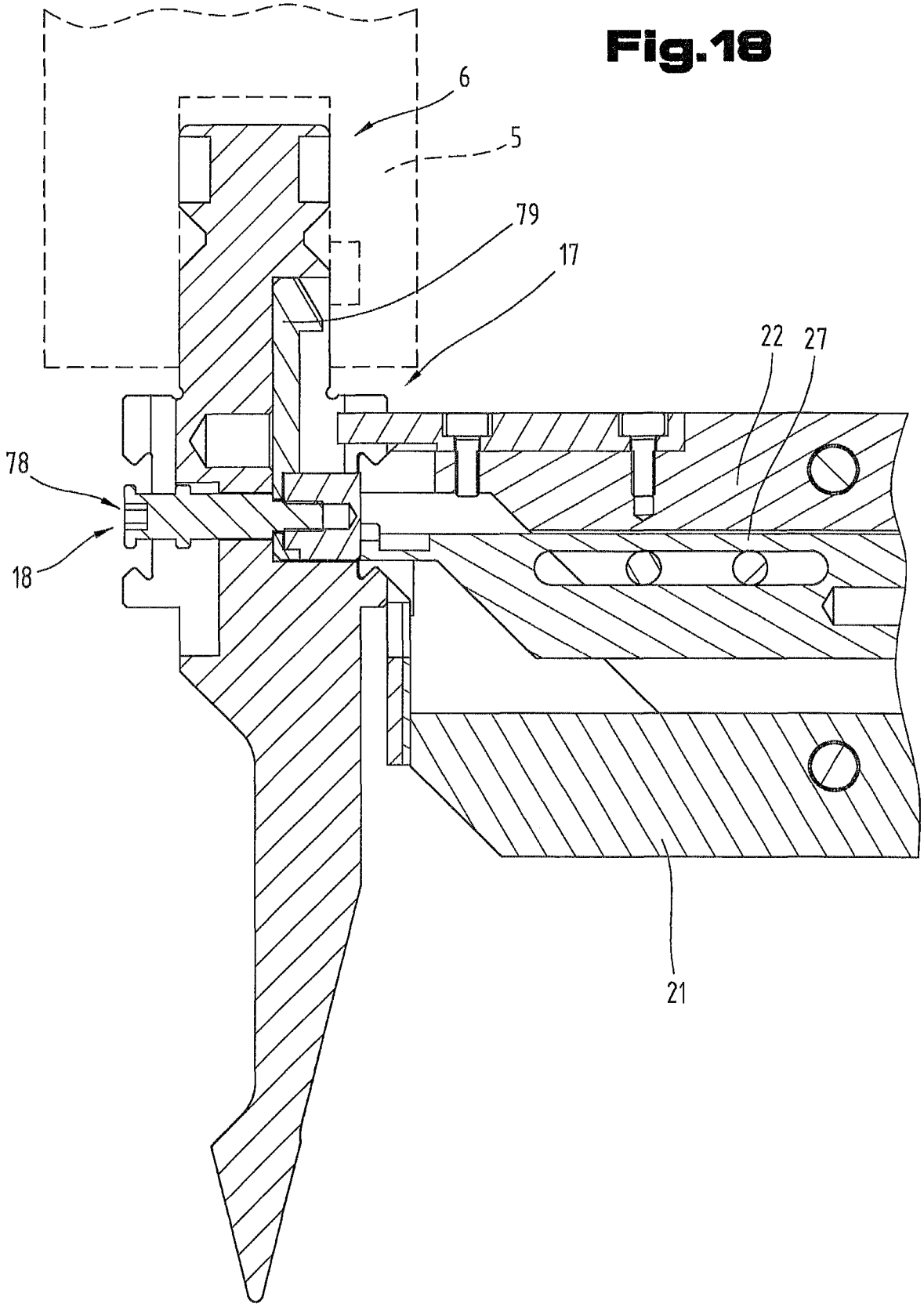
FIG. 18 a view of the gripping device with bending tool in holding step two, in which the gripping device is positioned on the first gripping groove in holding step three.

FIGS. 16 to 18 illustrate another method sequence for clamping and releasing a bending tool 6 in which the gripping device 11 engages in the first gripping groove 17 of the bending tool 6 in this instance. In other words, what is described here is how the bending tool 6 can be gripped from the opposite side.

In a first method step, the gripping device 11 is moved towards the bending tool 6 so that the gripping fingers 32 of the first respectively second gripping arm 21, 22 are positioned inside the first gripping groove 17. The gripping device 11 is then moved downwards by means of the carriage system 46 in a subsequent method step so that the gripping fingers 32 of the first gripping arm 21 sit in engagement with the first gripping groove 17 and touch one another.

In another method step illustrated in FIG. 17, the second gripping arm 22 is then moved upwards by means of the first actuator 25 in the clamping direction 26 and is thus moved relative to the first gripping arm 21 so that both the gripping fingers 32 of the first gripping arm 21 and the gripping fingers 32 of the second gripping arm 22 sit in engagement with the first gripping groove 17. As this happens, the unlocking element 27 secured to the second gripping arm 22 is simultaneously moved upwards as well.

In another method step illustrated in FIG. 18, the unlocking element 27 can now be pushed by the second actuator 38 in a direction facing the bending tool 6 so that the operating element 78 and coupled therewith the locking element 79 is moved out of its locking position into its releasing position.

The bending tool 6 can now be moved freely out of the tool holder 5 and/or can be inserted therein.

The bending tool 6 can be taken back to the tool storage in the same way as in the method sequence already described.

To set the bending tool 6 down, the operating element 78 can now be moved in the reverse sequence back into its normal position and the gripping device 11 disengaged from the bending tool 6.

The embodiments illustrated as examples represent possible variants of the gripper system 16, and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

Furthermore, individual features or combinations of features from the different embodiments illustrated and described may be construed as independent inventive solutions or solutions proposed by the invention in their own right.

The objective underlying the independent inventive solutions may be found in the description.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e.

all part-ranges starting with a lower limit of 1 or more and ending with an upper limit of 10 or less, e.g. 1 to 1.7, or 3.2 to 8.1 or 5.5 to 10.

Above all, the individual embodiments of the subject matter illustrated in FIGS. 1-18 constitute independent solutions proposed by the invention in their own right. The objectives and associated solutions proposed by the invention may be found in the detailed descriptions of these drawings.

For the sake of good order, finally, it should be pointed out that, in order to provide a clearer understanding of the structure of the gripper system 16, it and its constituent parts are illustrated to a certain extent out of scale and/or on an enlarged scale and/or on a reduced scale.

| List of reference numbers | |
|---|---|
| 1 | Processing system |
| 2 | Press brake |
| 3 | Metal sheet |
| 4 | First press beam |
| 5 | Tool holder |
| 6 | Bending tool |
| 7 | Second press beam |
| 8 | Press drive unit |
| 9 | Computer unit |
| 10 | Input/display unit |
| 11 | Gripping device |
| 12 | Tool body |
| 13 | Horizontal direction of movement |
| 14 | Vertical insertion direction |
| 15 | Bending edge |
| 16 | Gripper system |
| 17 | First gripping groove |
| 18 | Second gripping groove |
| 19 | Holder portion |
| 20 | Centering recess |
| 21 | First gripping arm |
| 22 | Second gripping arm |
| 23 | First gripping arm holder |
| 24 | Second gripping arm holder |
| 25 | First actuator |
| 26 | Clamping direction |
| 27 | Unlocking element |
| 28 | Gripping arm recess |
| 29 | Gripping portion |
| 30 | Gripping arm front end portion |
| 31 | Rear gripping arm region |
| 32 | Gripping finger |
| 33 | Center plane |
| 34 | Non-rotating longitudinal guide |
| 35 | Longitudinal direction |
| 36 | Guide bolt |
| 37 | Slot |
| 38 | Second actuator |
| 39 | Front end region of unlocking element |
| 40 | Centering projection |
| 41 | Chamfer |
| 42 | Fixing means |
| 43 | Wear protection element |
| 44 | Surface |
| 45 | Fixing means |
| 46 | Carriage system |
| 47 | Horizontal linear guide |
| 48 | Guide rail |
| 49 | Guide carriage |
| 50 | Rail support |
| 51 | Actuator |
| 52 | Pneumatic cylinder |
| 53 | Inserting position |
| 54 | Inoperative position |
| 55 | Vertical linear guide |
| 56 | Vertical guide rail |
| 57 | Vertical guide carriage |
| 58 | Vertical rail support |
| 59 | Actuator support |
| 60 | Cylinder |

-continued

| List of reference numbers | |
|---|---|
| 61 | Piston rod |
| 62 | Mounting support |
| 63 | Other actuator |
| 64 | Positioning carriage |
| 65 | Minimum position |
| 66 | Maximum position |
| 67 | Rail support positioning carriage |
| 68 | Guide rail positioning carriage |
| 69 | Lock mechanism |
| 70 | Other horizontal linear guide |
| 71 | Locking pin |
| 72 | End face |
| 73 | Toothed surface |
| 74 | Toothed rack |
| 75 | Lock cylinder |
| 76 | Gearwheel |
| 77 | Toothed rack |
| 78 | Operating element |
| 79 | Locking element |

The invention claimed is:

1. A gripper system for a press brake, having a first gripping device for manipulating a first bending tool of a plurality of bending tools, the first gripping device comprising:

a first gripping arm and a second gripping arm that is displaceable in a clamping direction relative to the first gripping arm, said gripping arms being configured to engage in a gripping groove of the first bending tool and to clamp the first bending tool, wherein the first gripping device is arranged on a carriage system, said carriage system comprising a first horizontal linear guide configured to displace the first gripping device towards the gripping groove or away from the gripping groove in a longitudinal direction of the gripping arms, wherein the carriage system further comprises a vertical linear guide, wherein the first horizontal linear guide and the first gripping device are disposed on the vertical linear guide so as to be vertically displaceable, an actuator, a pneumatic cylinder, an actuator support mounting the pneumatic cylinder, and a lock mechanism configured to fix a position of the actuator support in the longitudinal direction of the gripping arms, wherein the first horizontal linear guide comprises a guide carriage guided on a guide rail, wherein the first gripping device is received on the guide rail, wherein the guide carriage is configured to be positioned by the pneumatic cylinder, between an extracted inserting position of the first gripping device and a retracted inoperative position of the first gripping device, wherein the actuator is disposed between the guide rail and the pneumatic cylinder, wherein the actuator support and the entire pneumatic cylinder is movable by the actuator in the longitudinal direction of the gripping arms and thus enables the extracted inserting position of the first gripping device to be varied between a minimum position and a maximum position, and wherein the actuator comprises a servomotor configured to be steplessly displaced between the minimum position and the maximum position.

2. The gripper system according to claim 1, further comprising a second horizontal linear guide having a second gripping device, wherein the first horizontal linear guide has the first gripping device, and wherein the first and second horizontal linear guides are disposed on the vertical linear guide.

3. The gripper system according to claim 1, wherein the vertical linear guide is disposed on a second horizontal linear guide by which the first gripping device can be moved in a horizontal direction of movement of a tool holder of the press brake.

4. The gripper system according to claim 1, wherein a cylinder of the pneumatic cylinder is coupled with the guide rail and a piston rod of the pneumatic cylinder is coupled with the guide carriage.

5. The gripper system according to claim 4, wherein the cylinder of the pneumatic cylinder is disposed on a positioning carriage which can be moved horizontally relative to the vertical linear guide by the actuator.

6. The gripper system according to claim 1, wherein the lock mechanism comprises a locking pin which can be moved by a lock cylinder and the locking pin has a toothed surface on its end face and co-operates with a toothed rack, and when the lock cylinder is in an extracted state, the toothed surface engages in the toothed rack.

7. A bending press comprising:

a gripper system;

press beams; and tool holders with a plurality of bending tools received therein disposed or arranged on the press beams, each of the bending tools having a respective gripping groove, each of the bending tools being configured to be manipulated by the gripper system;

wherein the gripper system comprises:

a first gripping device for manipulating a first bending tool of the plurality of bending tools, the first gripping device comprising a first gripping arm and a second gripping arm that is displaceable in a clamping direction relative to the first gripping arm, said gripping arms being configured to engage in the gripping groove of the first bending tool and to clamp the first bending tool, wherein the first gripping device is arranged on a carriage system, said carriage system comprising a first horizontal linear guide configured to displace the first gripping device towards the gripping groove or away from the gripping groove in a longitudinal direction of the gripping arms, wherein the carriage system further comprises a vertical linear guide, wherein the first horizontal linear guide and the first gripping device are disposed on the vertical linear guide so as to be vertically displaceable, an actuator, a pneumatic cylinder, an actuator support mounting the pneumatic cylinder, and a lock mechanism configured to fix a position of the actuator support in the longitudinal direction of the gripping arms, wherein the first horizontal linear guide comprises a guide carriage guided on a guide rail, wherein the first gripping device is received on the guide rail, wherein the guide carriage is configured to be positioned by the pneumatic cylinder, between an extracted inserting position of the first gripping device and a retracted inoperative position of the first gripping device, wherein the actuator is disposed between the guide rail and the pneumatic cylinder, wherein the actuator support and the entire pneumatic cylinder is movable by the actuator in the longitudinal direction of the gripping arms and thus enables the extracted inserting position of the first gripping device to be varied between a minimum position and a maximum position, and wherein the actuator comprises a servomotor configured to be steplessly displaced between the minimum position and the maximum position.

* * * * *